US006163246A

United States Patent [19]

Ueda et al.

[11] Patent Number: 6,163,246

[45] Date of Patent: Dec. 19, 2000

[54] CHIP-TYPE ELECTRONIC DEVICE

[75] Inventors: Yukiko Ueda; Masahiko Kawase, both of Shiga, Japan

[73] Assignee: Murata Manufacturing Co., Ltd., Kyoto, Japan

[21] Appl. No.: 09/583,365

[22] Filed: May 31, 2000

[30] Foreign Application Priority Data

Jun. 10, 1999 [JP] Japan ..... 11-164051

[51] Int. Cl.[7] ..... H01C 1/46

[52] U.S. Cl. ..... 338/331; 338/22 R; 338/332; 338/22 SD

[58] Field of Search ..... 338/312, 313, 338/22 R, 22 SD, 331, 332, 20, 21

[56] References Cited

U.S. PATENT DOCUMENTS

| | | | |
|---|---|---|---|
| 4,912,450 | 3/1990 | Yoneda et al. | 338/22 R |
| 5,075,665 | 12/1991 | Taira et al. | 338/21 |
| 5,245,309 | 9/1993 | Kawase et al. | 338/22 R |
| 6,020,808 | 2/2000 | Hogge | 338/22 R |
| 6,078,250 | 6/2000 | Ueda et al. | 338/22 R |

*Primary Examiner*—Karl D. Easthom
*Attorney, Agent, or Firm*—Majestic, Parsons, Siebert & Hsue P.C.

[57] ABSTRACT

A chip-type electronic device has a sintered ceramic body formed by integrally sintering a plurality of ceramic layers, inner electrodes including first electrodes, second electrodes and a third electrode formed inside this sintered ceramic body and outer electrodes formed on both end surfaces of this sintered ceramic body. One end of each of the first electrodes is electrically connected to one of the outer electrodes. Each of the second electrodes is electrically connected to a corresponding one of the first electrodes through an associated one of throughholes through one of the ceramic sheets. The third electrode is electrically connected to the other of the outer electrodes and overlaps with the second electrodes as seen perpendicularly to the planar inner electrodes. The second electrodes are wider than the first electrodes, and the other end of each of the first electrodes is at a position longitudinally between the second electrode and the other of the outer electrodes such that no variations will result from inaccuracies in the formation of the electrodes or the placements of the ceramic sheets.

4 Claims, 4 Drawing Sheets

CHIP-TYPE ELECTRONIC DEVICE

BACKGROUND OF THE INVENTION

This invention relates to chip-type electronic devices which have inner electrodes.

Chip-type electronic devices of this kind have been known. FIGS. 4A and 4B show one of this kind (indicated generally by numeral 21) described in Japanese Patent Publication Tokkai 62-137804, comprising a sintered ceramic body 22, planar inner electrodes 24*a* and 24*b* and outer electrodes 27*a* and 27*b*. The sintered ceramic body 22 comprises a semiconductor porcelain material capable of functioning as a thermistor body. The inner electrodes 24*a* and 24*b* are formed in layers inside this sintered ceramic body 22, portions of their surfaces overlapping with each mutually adjacent pair thereof sandwiching a ceramic layer in between and one edge portion of each of these inner electrodes 24*a* and 24*b* being extended to one of mutually oppositely facing end surfaces. The outer electrodes 27*a* and 27*b* are formed over these end surfaces of the sintered ceramic body 22 so as to be each electrically connected to the edge portions of those of the inner electrodes 24*a* and 24*b* extending to the corresponding end surface of the sintered ceramic body 22.

With a prior art chip-type electronic device thus structured, the value of its resistance is sensitively dependent on the area of the mutually oppositely facing portions of the inner electrodes 24*a* and 24*b*. Thus, the variations in the resistance values of the devices tend to be large due to inaccuracies in the printing and superposition of the inner electrodes 24*a* and 24*b* during their production process.

SUMMARY OF THE INVENTION

It is therefore an object of this invention, in view of this problem with prior art chip-type electronic devices, to provide improved chip-type electronic devices so designed that there will be no variations in their resistance values even if inaccuracies are involved in the printing or superposition of their inner electrodes.

A chip-type electronic device embodying this invention, with which the above and other objects can be accomplished, may be characterized not only as comprising a sintered ceramic body formed by integrally sintering a plurality of ceramic layers, inner electrodes formed inside this sintered ceramic body and outer electrodes formed on both end surfaces of this sintered ceramic body but also wherein the inner electrodes includes first electrodes, second electrodes and a third electrode, one end of each of the first electrodes is electrically connected to one of the outer electrodes, each of the second electrode is electrically connected to a corresponding one of the first electrodes through an associated one of throughholes through an associated one of the ceramic sheets, the third electrode is electrically connected to the other of the outer electrodes, and the third electrode overlaps with the second electrodes as seen perpendicularly to the planar inner electrodes. The second electrodes are preferably wider than the first electrodes, and the other end of each of the first electrodes should preferably at a position longitudinally between the second electrode and the other of the outer electrodes such that no variations will result from inaccuracies in the formation of the electrodes or the placements of the ceramic sheets.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1A:
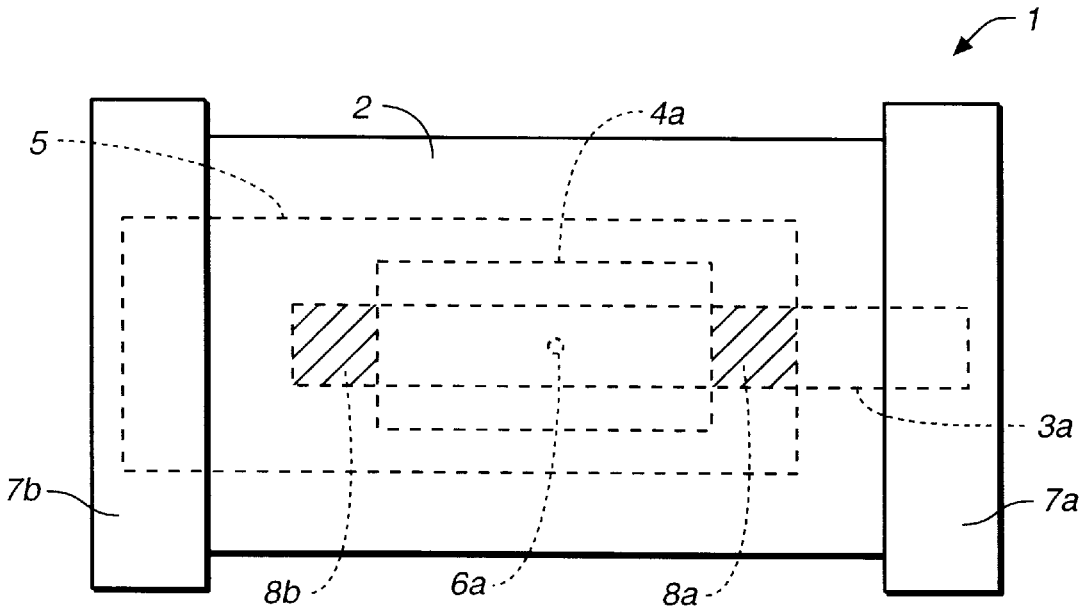
FIGS. 1A and 1B, together referred to as FIG. 1, are respectively a plan view and a sectional view of a chip-type electronic device embodying this invention.
Figure 1B:
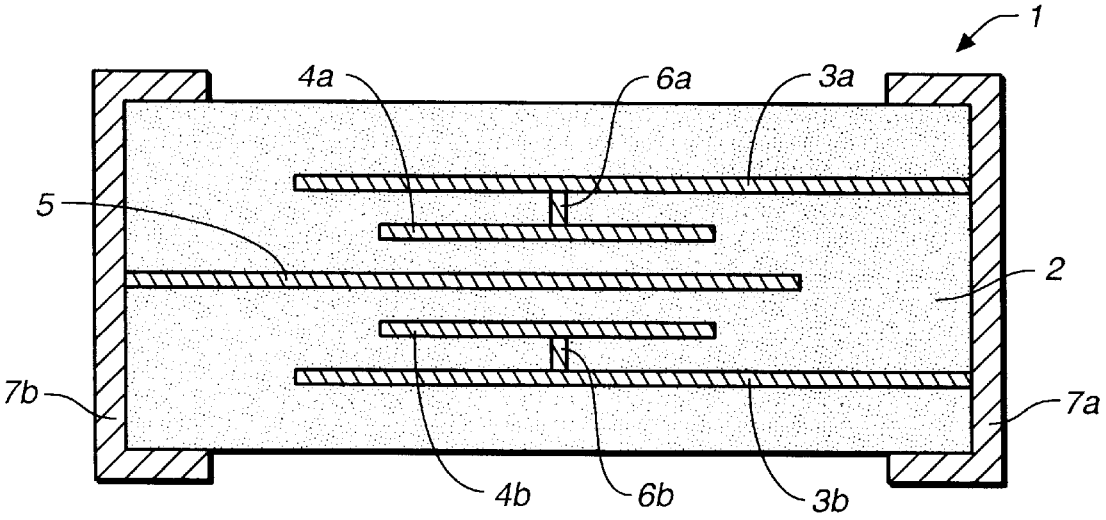

The invention will be described next by way of an example. As shown in FIGS. 1A and 1B, an electronic device in the form of a chip ("chip-type electronic device") 1 embodying this invention comprises a sintered ceramic body 2, a pair of first electrodes 3*a* and 3*b*, a pair of second electrodes 4*a* and 4*b*, a third electrode 5, a pair of through-holes 6*a* and 6*b* and outer electrodes 7*a* and 7*b*.

Figure 2A:
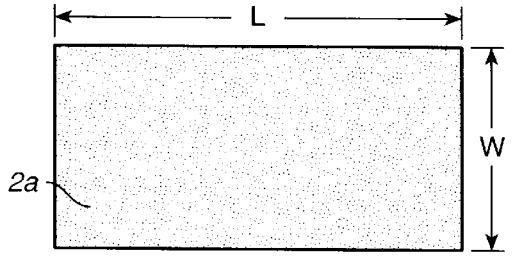
FIGS. 2A, 2B, 2C, 2D, 2E and 2F, together referred to as FIG. 2, are plan views of ceramic green sheets for forming the chip-type electronic device of FIG. 1.

The sintered ceramic body 2 is formed by stacking one on top of another the ceramic green sheets 2*a*–2*f* shown respectively in FIGS. 2A–2F and sintering them together to form an integral body. The first ceramic green sheet 2*a* is obtained by cutting a semiconductor porcelain material capable of functioning as a thermistor body such as Mn—Ni—Co ceramic into a rectangular shape with length L and width W, as shown in FIG. 2A.

Figure 2B:
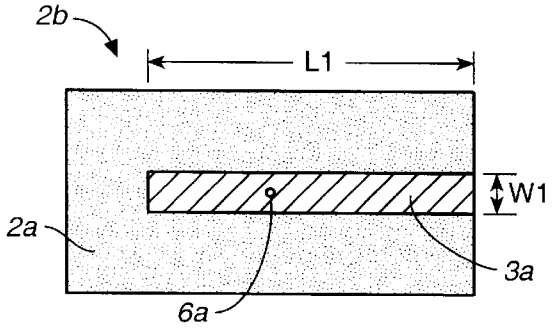

The second ceramic green sheet 2*b* is identical to the first ceramic green sheet 2*a* except there is the first electrode 3*a* formed thereon and the through hole 6*a* therethrough, as shown in FIG. 2B. The first electrode 3*a* is formed on one of the main surfaces of the ceramic green sheet by applying an electrically conductive paste of an Ag—Pd material such that its length L1 is less than L, its width W1 is less than W, one of its end parts reaches one of the edges of the ceramic green sheet 2*a* but the other of the end parts does not reach the opposite edge of the ceramic green sheet 2*a*. The throughhole 6*a* is formed from one to the other of the main surfaces of the ceramic green sheet 2*a* and an electrically conductive Ag—Pd paste is injected thereinto so as to be electrically connected to the second electrode 4*a*, as shown in FIG. 1B.

Figure 2C:
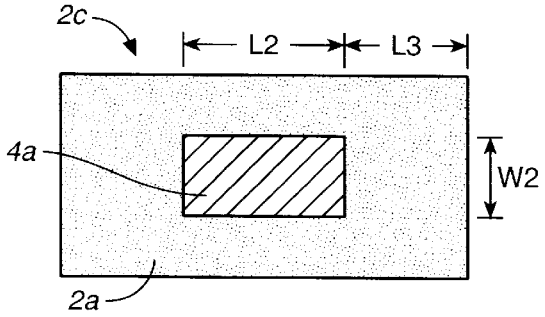

The third ceramic green sheet 2*c* is identical to the first ceramic green sheet 2*a* except there is the second electrode 4*a* formed thereon, as shown in FIG. 2C. The second electrode 4*a* is formed on one of the main surfaces of the first ceramic green sheet 2*a* by applying the electrically conductive Ag—Pd paste such that its length L2 is less than L, its width W2 is less than W, its distance from one of the edges of the green sheet 2*a* is L3 and neither of its end parts reaches an edge of the green sheet 2*a*.

Figure 2D:
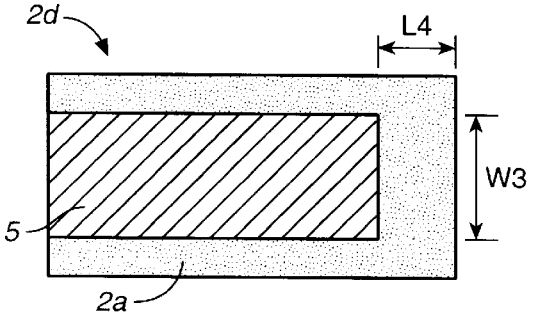

The fourth ceramic green sheet 2*d* is identical to the first ceramic green sheet 2*a* except there is the third electrode 5 formed, as shown in FIG. 2D. The third electrode 5 is formed on one of the main surfaces of the first ceramic green sheet 2*a* by applying the electrically conductive Ag—Pd paste such that its length is L–L4 where L4<L3, its width W3 is greater than W2, one of its end parts reaches one of the edges of the ceramic green sheet 2*a* but the other of the end parts does not reach the opposite edge of the ceramic green sheet 2*a*.

Figure 2E:
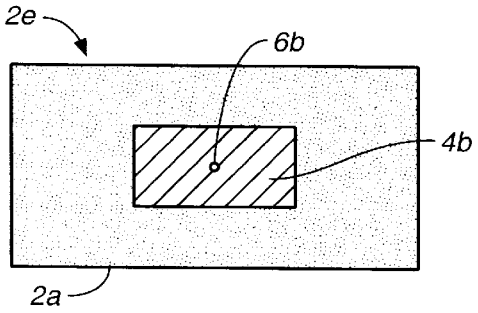

The fifth ceramic green sheet 2*e* is identical to the first ceramic green sheet 2*a* except there is the second electrode 4*b* formed thereon and the throughhole 6*b* therethrough, as shown in FIG. 2E. The second electrode 4*b* is formed identically as the second electrode 4*a* described above with reference to FIG. 2C. The throughhole 6*b* is formed from one to the other of the main surfaces of the ceramic green sheet 2*a* and the electrically conductive Ag—Pd paste is injected thereinto so as to be electrically connected to the first electrode 3*b*, as shown in FIG. 1B.

Figure 2F:
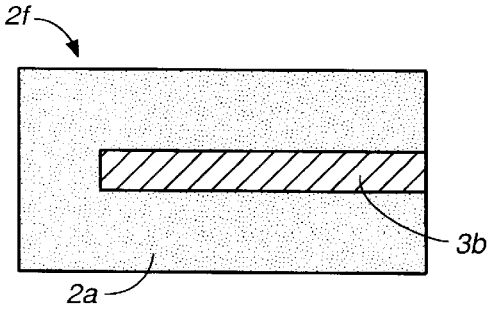

The sixth ceramic green sheet 2*f* is identical to the first ceramic green sheet 2*a* except there is the first electrode 3*b* formed thereon, as shown in FIG. 2F. The first electrode 3*b* is formed identically as the first electrode 3*a* described above with reference to FIG. 2B.

These ceramic green sheets 2*a*, 2*b*, 2*c*, 2*s*, 2*e* and 2*f* are stacked one on top of another in this order from above. Specified numbers of ceramic green sheets 2*a* may additionally be placed above and below and the assembly thus obtained is compressed together by means of a hydraulic press. Thereafter, it is sintered for 2 hours at 1200° C. to form the sintered ceramic body 2. Inside this sintered ceramic body 2, the first electrode 3*a* and the second electrode 4*a* are electrically connected to each other through the throughhole 6*a* by way of the electrically conductive paste therein. Similarly, the first electrode 3*b* and the second electrode 4*b* are electrically connected to each other through the throughhole 6*b* by way of the electrically conductive paste therein.

The outer electrodes 7*a* and 7*b* are formed by applying an electrically conductive paste with Ag as its main constituent on both edge parts of the sintered ceramic body 2 in its longitudinal direction and then subjecting it to a burning process. The end parts of the first and third electrodes 3*a*, 3*b* and 5 which are exposed externally on the longitudinal edge surfaces of the sintered ceramic body 2 become electrically connected each to a corresponding one of these outer electrodes 7*a* and 7*b*, as shown in FIG. 1B.

Figure 3A:
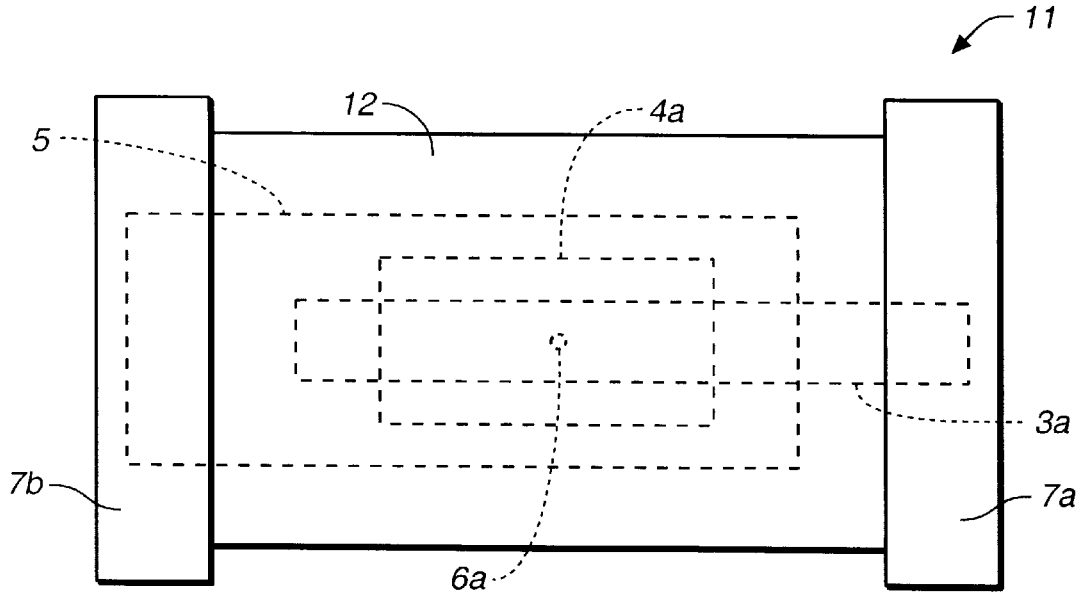
FIGS. 3A and 3B, together referred to as FIG. 3, are respectively a plan view and a sectional view of another chip-type electronic device according to another embodiment of this invention.
Figure 3B:
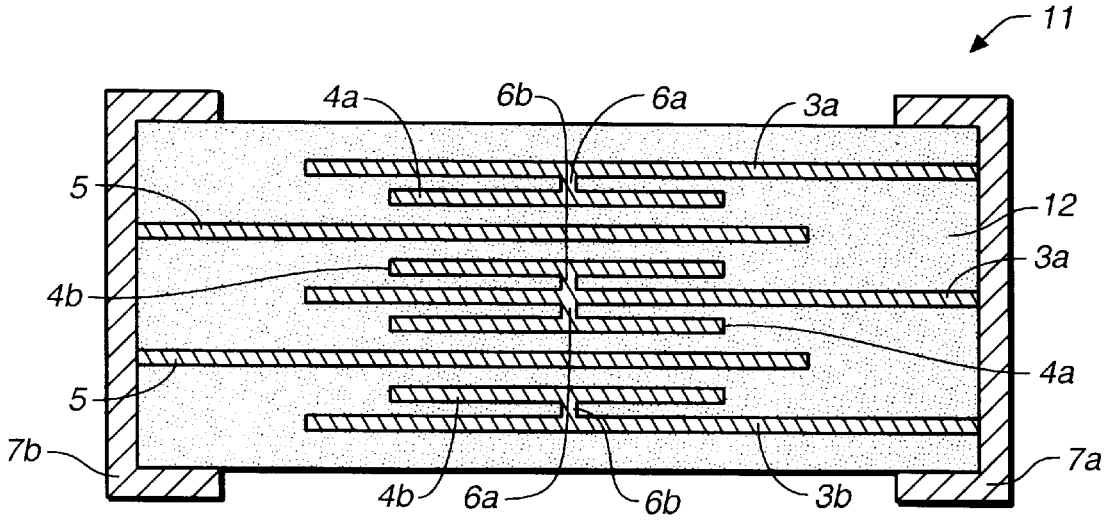
Figure 4A:
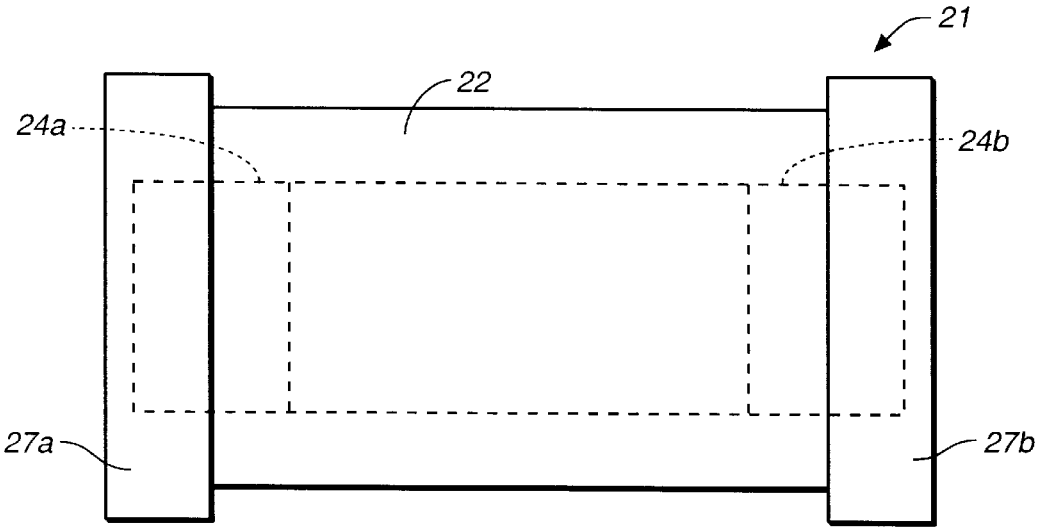
FIG. 4A (PRIOR ART)
FIGS. 4A and 4B are respectively a plan view and a sectional view of a prior art chip-type electronic device.
Figure 4B:
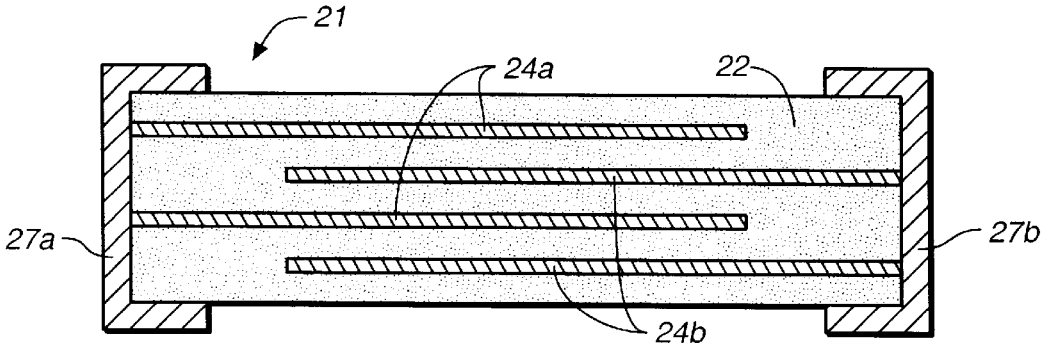
FIG. 4B (PRIOR ART)

Another chip-type electronic device 11 according to another embodiment of this invention is described next with reference to FIGS. 3A and 3B wherein some of the components which are like or similar to those already described above with reference to FIGS. 1 and 2 are indicated by the same symbols and may not be explained repetitiously.

The electronic device 11 according to the second embodiment of the invention also comprises a sintered ceramic body 12, first electrodes 3*a* and 3*b*, second electrodes 4*a* and 4*b* and third electrodes 5, throughholes 6*a* and 6*b* and outer electrodes 7*a* and 7*b*, but the sintered ceramic body 12 according to this embodiment is formed by stacking the ceramic green sheets 2*a*–2*f* as shown in FIG. 2 one on top of another in the order of 2*a*, 2*b*, 2*c*, 2*d*, 2*e*, 2*b*, 2*c*, 2*d*, 2*e* and 2*f* from above such that their electrodes are partially overlapped, as shown in FIG. 3. Specified numbers of ceramic green sheets 2*a* may additionally be placed above and below and the assembly thus obtained is compressed together by means of a hydraulic press. Thereafter, it is sintered for 2 hours at 1200° C. to form the sintered ceramic body 12. Inside this sintered ceramic body 2, each first electrode 3*a* is electrically connected to a corresponding one of the second electrodes 4*a* through one of the throughholes 6*a* (by way of an electrically conductive paste). Similarly, each of the first electrodes 3*b* is electrically connected to a corresponding one of the second electrodes 4*b* through one of the throughholes 6*b* (by way of an electrically conductive paste). The outer electrodes 7*a* and 7*b* are formed on both edge parts of the sintered ceramic body 12 in its longitudinal direction.

The invention has been described above by way of only two embodiments but they are not intended to limit the scope of the invention. Many modifications and variations are possible within the scope of the invention. The invention was described also generally. In the description given above, in particular, it is preferable that the inequality W2>W1 should hold. This is because, although it is desirable that the resistance value of the device 1 or 11 be determined by the second electrodes 4*a* and 4*b* and the third electrode 5 which face each other inside the sintered ceramic body 2 or 12, there is resistance also between the first electrodes 3*a* and 3*b* and the third electrode 5. If the first electrodes 3*a* and 3*b* are narrower than the second electrodes 4*a* and 4*b* (or W1<W2) and the third electrode 5 is still wider, the resistance values between the first electrodes 3*a* and 3*b* and the third electrode 5 do not change even if the inner electrodes are formed somewhat displaced in the direction of their width. In other words, variations do not result in the resistance among produced devices embodying this invention.

It is also preferable that the length L1 of the first electrodes 3*a* and 3*b* be greater than the sum of the length L2 of the second electrodes 4*a* and 4*b* and the distance L3 of the second electrodes 4*a* and 4*b* from the corresponding edge of the ceramic green sheet 2*a*, or L1>L2+L3. FIG. 1 shows an example wherein this condition is satisfied, the first electrodes 3*a* and 3*b* extending to the right-hand edge of the sintered ceramic body 2 and facing opposite the third electrode 7 through a ceramic layer over an area 8*a* which is shown diagonally shaded. If the second electrodes 4*a* and 4*b* are formed with inaccuracies in the length in the longitudinal direction of the ceramic green sheet 2*a*, the size of the area 8*a* will change and this affects the resistance value. If the condition L1>L2+L3 is satisfied, however, the first electrodes 3*a* and 3*b* are in a face-to-face relationship with the third electrode 5 also over another area 8*b* on the left-hand side of the second electrodes 4*a* and 4*b*, the sum of the areas 8*a* and 8*b* being constant. Thus, there is no variation resulting in the resistance value even if the inner electrodes are formed displaced in the longitudinal direction of the ceramic green sheet 2*a* or if the ceramic green sheets 2*a* are superposed inaccurately.

The invention does not impose any particular limitation as to the distances among the first, second and third electrodes 3*a*, 3*b*, 4*a*, 4*b* and 5 in the direction of their thicknesses. In order that the separations between the second electrodes 4*a* and 4*b* and the third electrode 5 determine the resistance value of the device, however, it is preferred to make the distance between the second electrodes 4*a* and 4*b* and the third electrode 5 greater than that between the first electrodes 3*a* and 3*b* and the second electrodes 4*a* and 4*b*.

After the outer electrodes 7*a* and 7*b* are formed as thick films, they may be plated with a material such as Ni and Sn.

Neither does the material for the sintered ceramic body limit the scope of the invention. Use may be made equally well of other semiconductor porcelain materials for obtaining the sintered ceramic body such as Mn—Ni ceramics, Mn—Ni—Zn ceramics or those other ceramic materials comprising two or more selected from Mn, Ni, Co, Fe, Cu and Al. It also goes without saying that the present invention applies not only to negative temperature coefficient (NTC) thermistors but also the positive temperature coefficient (PTC) thermistors, varistors and capacitors. In summary, chip-type electronic devices according to this invention have the advantage that no variations in their resistance values result from inaccuracies in the formations of their electrodes or placements of their ceramic green sheets.

What is claimed is:

1. A chip-type electronic device comprising:

sintered ceramic body comprising a plurality of integrated layered ceramic sheets;

planar inner electrodes which extend mutually parallel in a longitudinal direction inside said ceramic body; and a pair of outer electrodes on mutually oppositely facing end surfaces of said ceramic body; wherein said inner electrodes include first electrodes, second electrodes and a third electrode;

one end of each of said first electrodes is electrically connected to one of said outer electrodes;

each of said second electrode is electrically connected to a corresponding one of said first electrodes through an associated one of throughholes through an associated one of said ceramic sheets;

said third electrode is electrically connected to the other of said outer electrodes; and said third electrode overlaps with said second electrodes, covering said second electrodes as seen perpendicularly to said planar inner electrodes.

2. The chip-type electronic device of claim 1 wherein said second electrodes are wider than said first electrodes.

3. The chip-type electronic device of claim 1 wherein the other end of each of said first electrodes is at a position in said longitudinal direction between said second electrode and said other outer electrode.

4. The chip-type electronic device of claim 2 wherein the other end of each of said first electrodes is at a position in said longitudinal direction between said second electrode and said the other outer electrode.

* * * * *